US006138658A

United States Patent [19]

Bell

[11] Patent Number: 6,138,658

[45] Date of Patent: Oct. 31, 2000

[54] CONCRETE CUTTING CHAIN WITH SEALED JOINTS

[75] Inventor: Don A. Bell, Portland, Oreg.

[73] Assignee: Blount, Inc., Portland, Oreg.

[21] Appl. No.: 09/267,453

[22] Filed: Mar. 12, 1999

[51] Int. Cl.[7] ..... B28D 1/00

[52] U.S. Cl. ..... 125/21; 83/830; 83/832; 30/381

[58] Field of Search ..... 125/21, 22; 83/830, 83/832; 30/381

[56] References Cited

U.S. PATENT DOCUMENTS

| | | | |
|---|---|---|---|
| 1,655,856 | 1/1928 | Bens | 83/832 |
| 3,298,406 | 1/1967 | Erickson | 83/832 |
| 4,546,755 | 10/1985 | Gustavsson | 125/21 |
| 5,123,400 | 6/1992 | Edgerton | 125/21 |
| 5,386,756 | 2/1995 | Stehle | 83/830 |
| 5,645,039 | 7/1997 | Egger et al. | 125/21 |

*Primary Examiner*—M. Rachuba
*Attorney, Agent, or Firm*—Robert L. Harrington

[57] ABSTRACT

A saw chain for cutting aggregate material has sealing members to seal the pivotal connection between the center drive links and the rivets to prevent entry of contaminates into the bearing surfaces. In one arrangement, O-rings are mounted in grooves of the tie straps with the O-ring being compressively forced against the center drive link. The O-ring prevents entry of contaminants into the bearing surface between the bore of the center drive link and the rivet. In another arrangement spring type cup washers fit in a groove of the tie straps and the cup washers are biased against the center drive link.

5 Claims, 4 Drawing Sheets

CONCRETE CUTTING CHAIN WITH SEALED JOINTS

FIELD OF THE INVENTION

This invention relates to a saw chain used for cutting through hardened concrete and more particularly to the manner by which wearing of the saw chain is reduced.

BACKGROUND OF THE INVENTION

Saw chain used for cutting concrete suffers unique wearing problems. Unlike wood cutting which primarily removes wood material in the form of chips, concrete cutting removes material by abrasion in the form of minute particles referred to as fines. If uncontrolled, the fines envelope the entire surrounding and permeates through the tiniest cracks and crevices. Control of the fines is achieved using copious amounts of water under pressure. Water is flowed through the saw chain and captures the fines to become a slurry. The water also provides cooling of the work tools and work surface as the abrasion form of cutting generates extreme heat.

A particular problem experienced by saw chain is that the saw chain is constructed of numerous individual links, center links and side links, pivotally connected together by rivets. Each link is provided with a front and rear rivet hole and a rear hole of a center link is aligned with the front holes of a pair of following side links, and the front hole of the center link is aligned with the rear holes of a pair of leading side links. Rivets projected through the aligned holes join the links together and the sequence is repeated throughout to form a desired loop of saw chain. The loop is mounted on a guide bar and drive sprocket and travels in a substantially oval path.

As the individual links travel around the defined oval path, the links pivot relative to each other particularly when traversing the ends. The substantial drive power necessary to drive the saw chain is imparted by the drive sprocket whose teeth are designed to fit between successive center links and engages the rear edges of the center links.

The problem to which the present invention is directed is the wearing of the chain due to the pivoting action. The rivets are clamped to the side links so that the bearing surfaces, i.e., where relative movement takes place, is the cylindrical surface of the rivets and the engaged inner walls surrounding the rivet holes of the center links.

Even though the center links and side links fit closely together, the slurry of fines and water gets into and between the bearing surfaces and accelerates wearing. To reduce such wearing, the water pressure is increased, e.g., to 100 psi to maintain a high rate of flow of water which at least partially reduces the abrasive action of the slurry (fines admixed with the water).

The 100 psi water pressure itself causes problems as it is not readily available at many job sites. Furthermore, wearing is still excessive. Such wearing causes chain stretch to the point where the sprocket no longer properly fits between the center links causing a further wearing problem. In combination, the wearing prematurely reduces the life of the chain far sooner than what can be provided as the cutting teeth life.

SUMMARY OF THE INVENTION

In a preferred embodiment of the present invention, the juncture/bearing surfaces at the rivet and hole edge portions of the center links are sealed from the slurry flow by providing a circular groove surrounding the rivet hole in the side links at both sides of the center link, providing a lubricant at the bearing surfaces and seating an O-ring in the grooves. The groove and 0ring are mated so that the securement of the rivets in the holes squeezes the O-ring between the face of the center links and into the groove to thereby provide a circular seal surrounding the rivet.

Alternatively, other forms of sealing may be provided. One such form is a type of low friction bevel washer that is compressed between the center link and side link.

With the sealing of the bearing surfaces, tests have established a substantially increased length of service life and readily offsets the cost of providing the seal. Furthermore, the high water pressure is no longer required or desired and the pressure can be reduced, e.g., to the range of 10 psi.

These and other benefits will be appreciated upon reference to the detailed description and drawings referred to therein which follow.

DESCRIPTION OF THE PREFERRED EMBODIMENT

Figure 1:
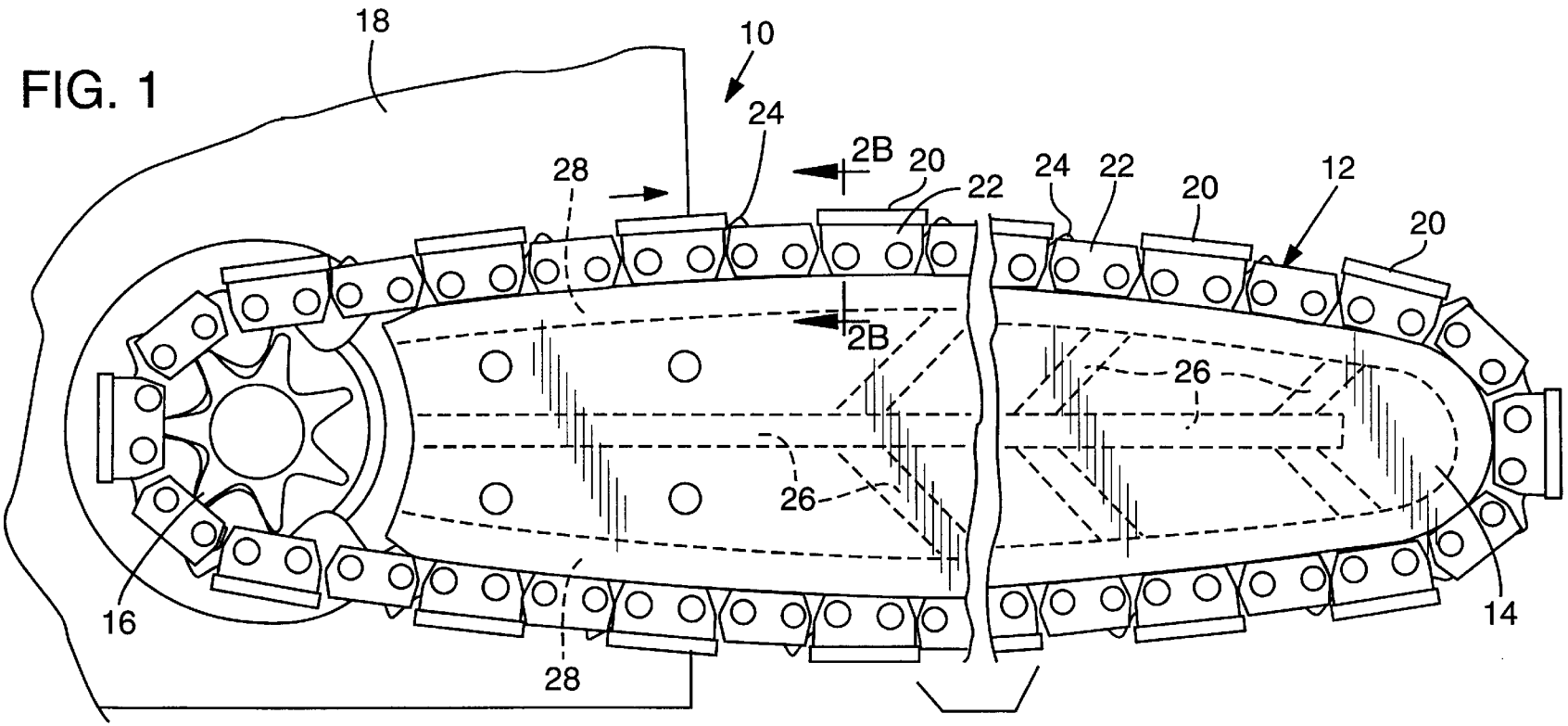
FIG. 1 is a view of a chain saw for cutting aggregate material.

FIG. 1 illustrates a chain saw 10 arranged for the cutting of aggregate material. The saw 10 is of the type that has an articulated saw chain 12 mounted on a guide bar 14. The saw chain 12 is driven around the guide bar 14 by a drive sprocket 16. The drive sprocket 16 is driven by a power head 18.

The saw chain typically has cutting blocks 20 mounted on pairs of side links (tie straps) 22. The cutting blocks 20 engage and erode away the aggregate material as the chain 12 is propelled around the guide bar 14. Protective guards 24 are usually provided between successive cutting blocks 20 to protect the blocks 20 from impacting forces.

The fines produced by the cutting blocks 20 eroding away the aggregate material is very abrasive and therefore it is preferable that the fines be removed from the moving saw chain and further that the fines be prevented from entering movable bearing surfaces of the saw chain.

The guide bar 14 is provided with internal channels 26 to deliver a flushing and cooling fluid to the guide groove 28. The flushing and cooling fluid flushes the fines produced by the cutting blocks 20 out of the groove 28 and away from the chain 12. Additionally the flushing fluid provides a lubricant for the saw chain 12 and the guide groove 28.

Some of the fines become admixed with the flushing fluid which produces a very abrasive slurry. Preventing the slurry from entering into the bearing surface between the saw chain links and the rivets is vital to reduce chain wear. The center drive links of the saw chain pivot on the rivets as the chain is propelled around the guide bar.

Figure 2:
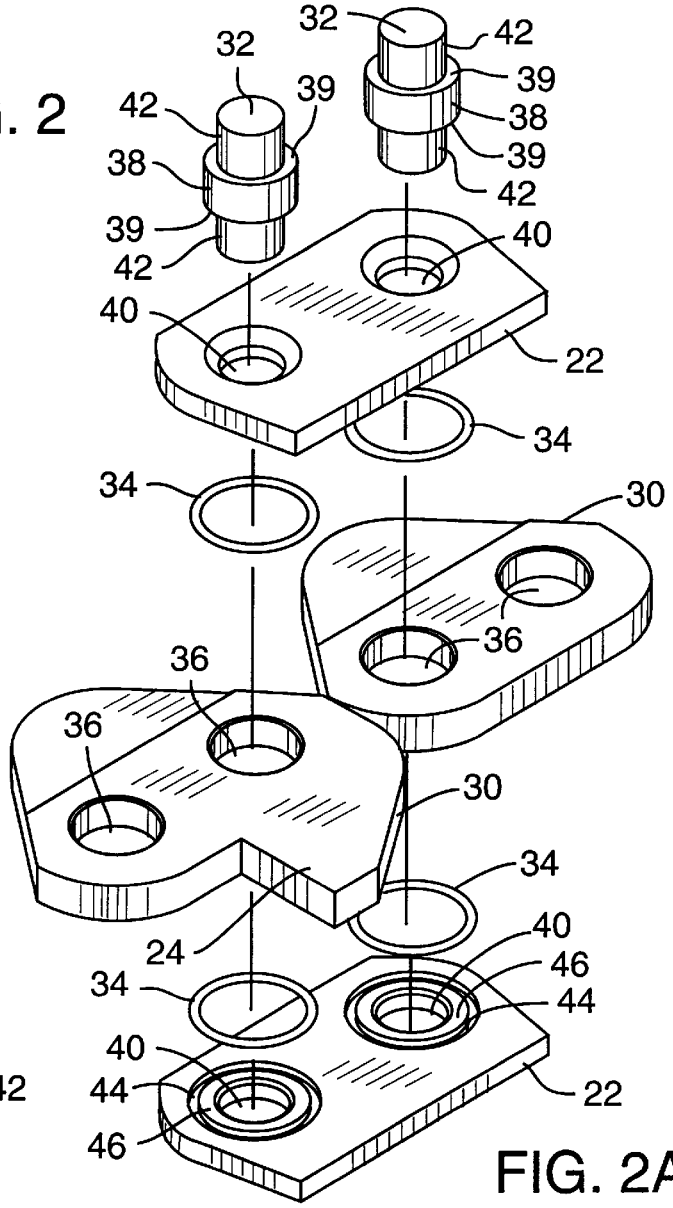
FIG. 2 is an exploded view of one embodiment of a portion of saw chain for the chain saw of FIG. 1.

FIG. 2 illustrates a partial exploded view of one embodiment of a saw chain 12 that has a sealing member to prevent fines from entering the bearing surface of the rivet and the drive links. Shown in FIG. 2 are center drive links 30, side links (tie straps 22), rivets 32 and resilient members 34, e.g., in the form of elastomeric O-rings. Each center link 30 has bores 36 sized to receive the center portion 38 of rivets 32. The side links 22 have bores 40 to receive the shank portion 42 of the rivets 22. Each side link 22 has grooves 44 concentric to the bores 40 to receive O-rings 34.

Figure 2B:
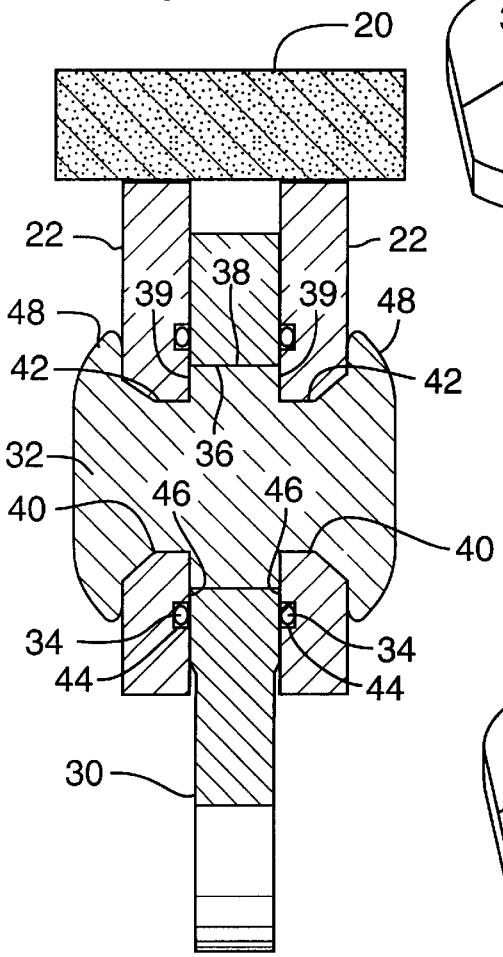
FIG. 2B is a sectional view as if taken on view lines 2B—2B of FIG. 1.
Figure 2A:
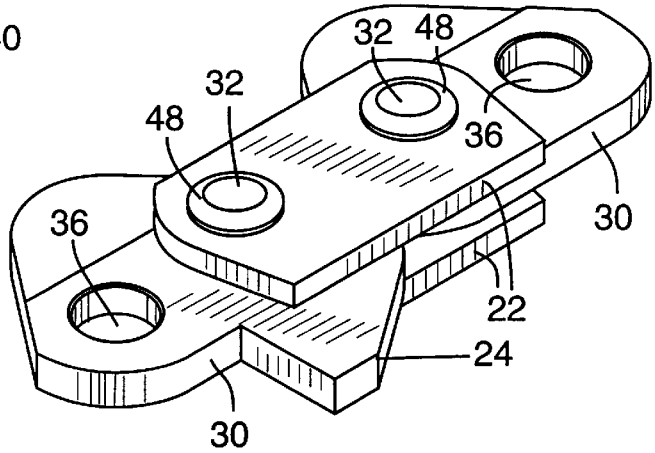
FIG. 2A is an assembled view of the saw chain of FIG. 2.

Portions of the assembled chain are shown in FIGS. 2A and 2B. Basically O-rings 34 are inserted in the grooves 44 of the side links 32 as seen in FIG. 2B. Lubricant is applied to the center portion 38 of the rivet 32 and to the land 46 between the grooves 44 and the bore 36. The rivets 32 are installed in the drive links 30 with the center portion 38 fitting in the bore 36. The side link is fitted to the rivet 32 with the shank portion 42 fitting in the bore 40 of the rivet 32. An end of the shank portion 42 of the rivet is formed into a head 48 such as by spinning. The spinning operation fixedly clamps the side link between the head 48 of the rivet 32 and a shoulder 39 of the center portion 38 of the rivet 32. The rivet 32 is fixedly held in a non-rotative position relative to the side link 22.

The resilient O-rings 34 are compressively forced into the grooves 44 of the side links 22 with the O-rings 34 in compressive contact with the center drive link 30. The O-rings 34 provide a very effective seal to prevent fluids or other contaminants from entering between the center drive link 30 and the side links 22. The seals also prevent the lubricant from escaping from the bearing surfaces and it will be appreciated that the O-rings may have varying cross sections, e.g., square shaped rather than round as shown in the drawings. The center drive link 30 is pivotable on the center portion 38 of the rivet 32. The center drive link 30 will pivot on the center section 38 of the rivet 32 to permit the articulation of the chain around the guide bar 14. The bearing surface between the center portion 38 of the rivet 32 and the bore 36 of the center drive link is thus completely sealed from the entry of any foreign contaminant.

Figure 3:
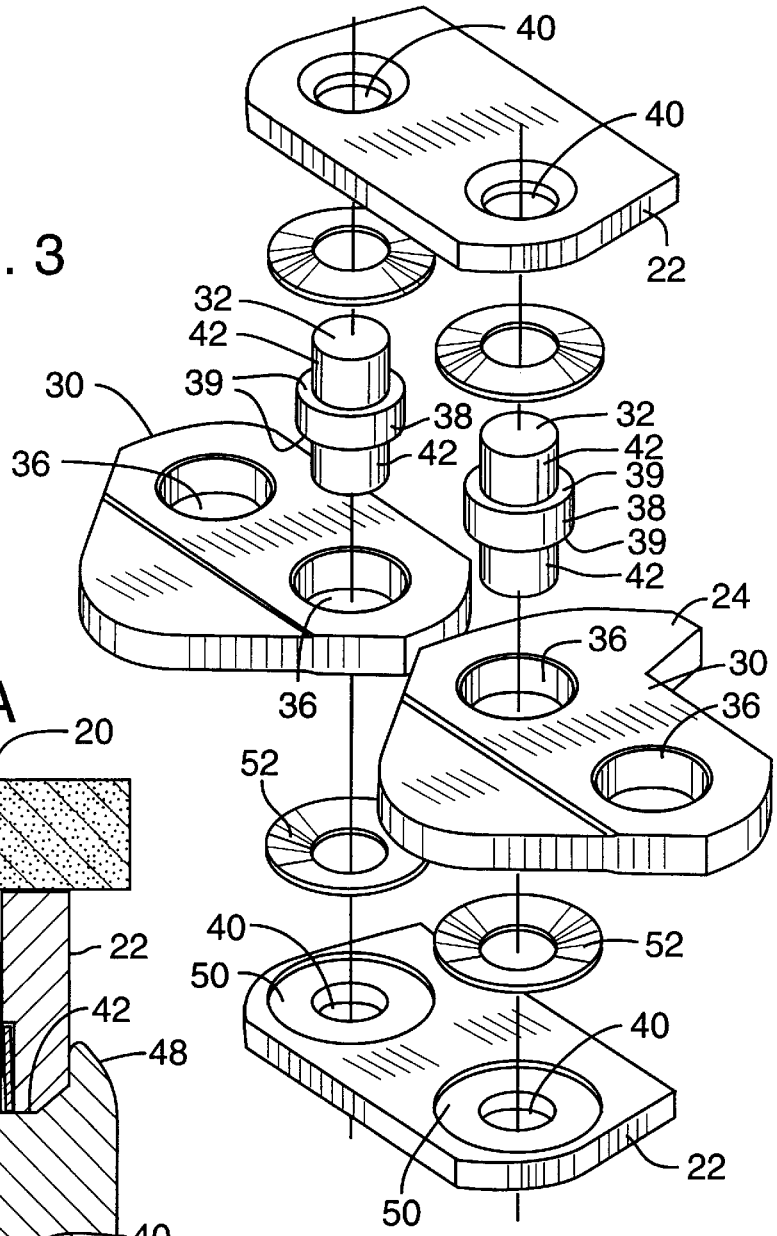
FIG. 3 is an exploded view of another embodiment of a portion of saw chain for the chain saw of FIG. 1.
Figure 3A:
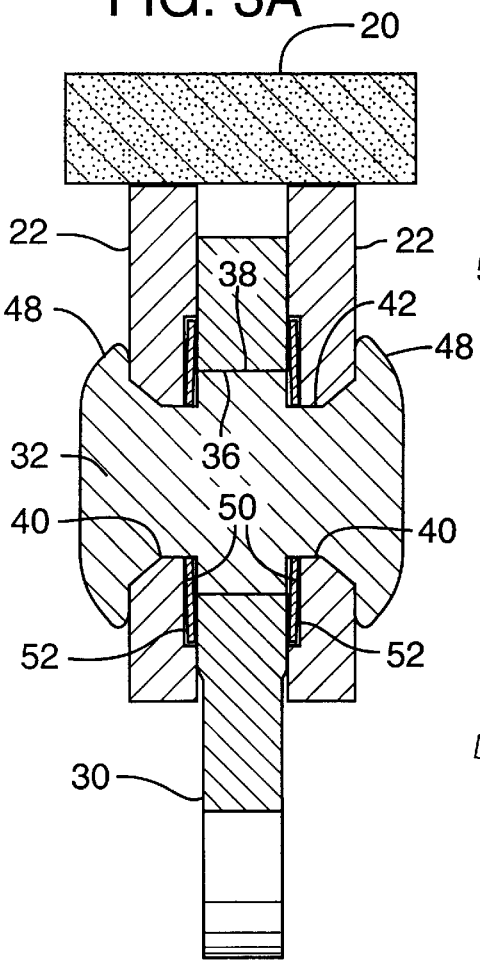
FIG. 3A is a sectional view similar to FIG. 2B but of the saw chain of FIG. 3.
Figure 3B:
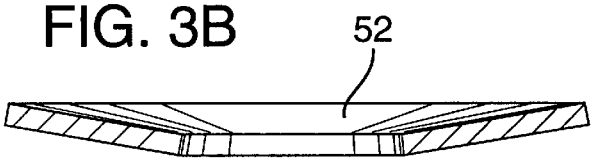
FIG. 3B is a sectional view of a spring type cup washer of the saw chain of FIG. 3.

FIGS. 3 and 3A illustrate another arrangement for sealing the bearing surface between the center portion 38 of the rivet 32 and the bore 36 of the drive link 30. As illustrated, the center drive link 30 has bores 36 that receive the center portion 38 of the rivet 32. The side links 22 have bores 40 sized to receive the shank portion 42 of the rivets 32. The side links 22 have a formed groove 50 that is concentric to the bore 40. The elastomeric 0rings are replaced by resilient cup-type washer springs 52 (FIG. 3B) that are sized to fit in the groove 50 and will provide a seal as later explained.

FIG. 3A shows the assembly of the components of FIG. 3 and as previously described, a head 48 is formed on the rivet 32. During the spinning operation of the rivet 32, the cup washer 52 received in the groove 50 of the side link 22 is forced against the side of the center drive link 30 and against the base of the groove 50. The cup washer 52 received in the groove 50 is yieldably compressed to bear against the side of the drive link 30. The cup washers 52 bearing against the sides of the drive link provide a seal to prevent any contaminant from entering into the bearing area between the center section 38 of the rivet 32 and the bore 36 of the drive link 30. The spinning operation of the rivet head 48 seals the bore 40 of the side link 22 to prevent entry of any contaminant through the bore 40 of the side links 22. As previously explained, the rivet 32 is non-rotative relative to the side links 22. However, the center drive link 30 will pivot on the center section 38 of the rivet 32 to permit the articulation of the chain around the guide bar 14.

The sealing arrangement illustrated in FIGS. 2–3 in effect provide a chamber sealed by the O-rings and cup washers to prevent the escape of lubricant provided to the bearing surfaces at the center section 38 of the rivet 32 and the bore 36 on the drive link 30. The sealed chambers also prevent entry of fines or slurry to the bearing surfaces between the center drive links and the rivets of the saw chain.

Figure 4A:
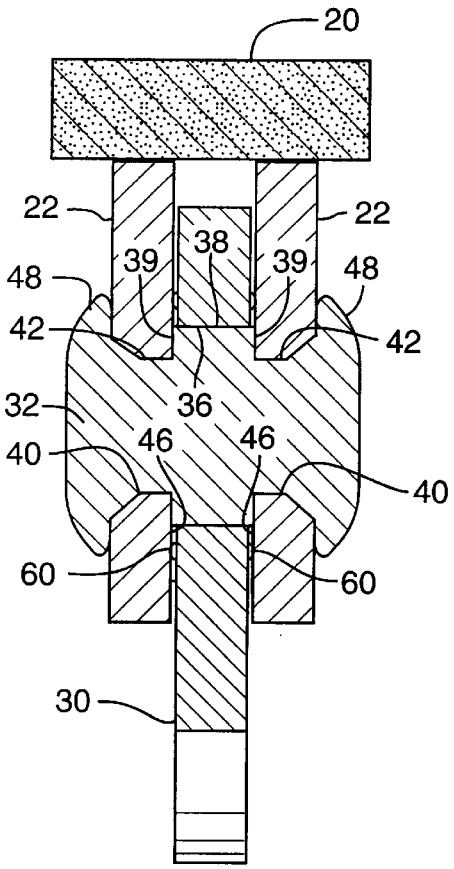
FIGS. 4A, 4B and 4C are views of a third embodiment of the invention.
Figure 4B:
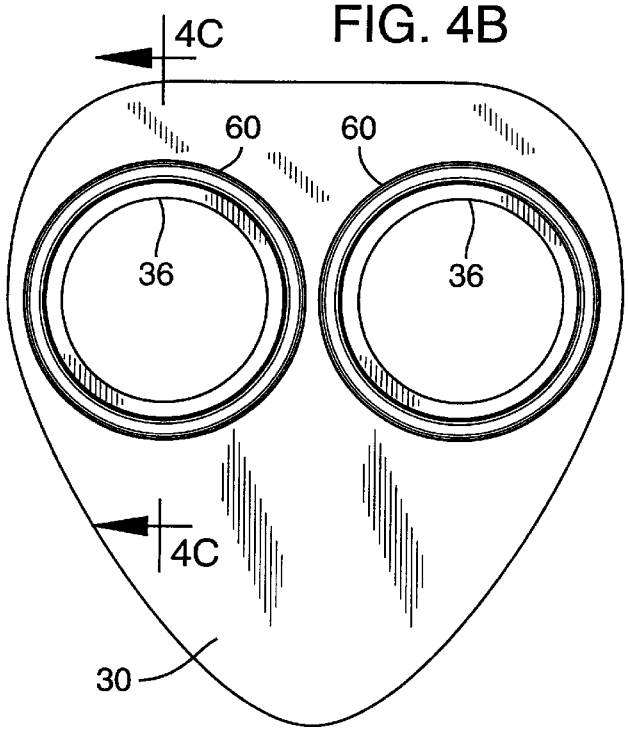
Figure 4C:
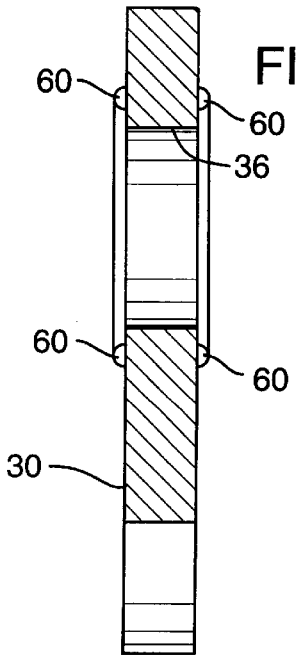

A third embodiment of the invention is illustrated in FIGS. 4A–4C. In this third embodiment, the seal surrounding the rivet holes is provided by bonding a ring of elastomer 60 to the face of the center drive link 30. The side links 22 when assembled to the center link 30 compress the torus shaped elastomer ring to provide the desired seal (FIG. 4C illustrates the elastomer before compression). The side links will be spaced slightly from the center link as there is no groove provided for this embodiment (but, of course, there could be). Good results have been achieved for the embodiment of FIGS. 4A–4C using VITRON™ as the seal material.

It will be understood that the ring of elastomer in FIGS. 4A–4C can be readily applied to the side links 22 rather than the center drive link 30. This reversal is also true for the embodiments of FIGS. 1–3. The O-rings and cup washers can be placed in grooves such as 50 or 44 that are formed in the center drive link 30 as opposed to side links 22.

Those skilled in the art will recognize that other modifications and variations may be made without departing from the true spirit and scope of the invention. The invention is therefore not to be limited to the embodiments described and illustrated but is to be determined from the appended claims.

The invention claimed is:

1. A concrete cutting saw chain comprising:

an assembly of saw chain links including center links and side links having front and back openings cooperatively aligned, and rivets projected through aligned openings of a pair of side links and a center link to inter-connect pairs of side links with center links in alternating sequence to form a loop of saw chain;

each rivet connection providing a pivotal axis around which a center link pivots relative to a pair of side links and defining adjacent interfacing surfaces on each center link and each side link having relative circular sliding movement and further defining a passageway between said interfacing surfaces extending into and surrounding the openings occupied by said rivets; and resilient members between said adjacent interfacing surfaces and surrounding the openings occupied by said rivets, said resilient members being compressed against the adjacent interfacing surfaces of the saw chain links to provide a circular seal that closes the passageway and prevents contaminants from entering said openings through said passageways.

2. A concrete cutting saw chain as defined in claim 1 including a circular groove formed in one of said interfacing surfaces surrounding said opening and the resilient member seated in the groove and biasingly pressed against the other of said interfacing surfaces.

3. A concrete cutting saw chain as defined in claim 2 wherein the resilient member is an elastomeric O-ring secured in place by said groove and configured and sized to protrude outwardly of said groove and compressed by assembly of the chain against the other of said interfacing surfaces.

4. A concrete cutting saw chain as defined in claim 2 wherein the resilient member is a cup-type washer spring.

5. A concrete cutting saw chain as defined in claim 1 wherein the resilient member is a ring of elastomer material bonded to the face and surrounding the rivet hole of one of the center and side links.

* * * * *